United States Patent [19]

Bonfiglioli et al.

[11] Patent Number: 4,502,436

[45] Date of Patent: Mar. 5, 1985

[54] CARBURETOR FOR INTERNAL COMBUSTION ENGINES WITH ELECTROMAGNETIC CONTROLLED DEVICES FOR POSITIONING THE THROTTLE IN TWO POSITIONS WITH SMALL OPENINGS

[75] Inventors: Silverio Bonfiglioli, Zola Predosa; Giovanni Gardellini, Casalecchio di Reno, both of Italy

[73] Assignee: Weber S.p.A., Turin, Italy

[21] Appl. No.: 392,677

[22] Filed: Jun. 28, 1982

[30] Foreign Application Priority Data

Jul. 10, 1981 [IT] Italy ..... 3477 A/81

[51] Int. Cl.[3] ..... F02D 9/08; F02D 11/10

[52] U.S. Cl. ..... 123/339; 123/376

[58] Field of Search ..... 123/339, 371, 376, 320, 123/323, 324, 325, 332; 261/DIG. 18, DIG. 19, DIG. 39 B

[56] References Cited

U.S. PATENT DOCUMENTS

| | | | |
|---|---|---|---|
| 4,171,686 | 10/1974 | Chenet | 123/339 |
| 4,212,272 | 7/1980 | Hauk | 123/339 |
| 4,237,833 | 12/1980 | Des Lauriers | 123/339 |
| 4,250,709 | 2/1981 | Conrad et al. | 123/339 |
| 4,253,437 | 3/1981 | Haramoto | 123/339 |
| 4,300,501 | 11/1981 | Suzuki | 123/339 |
| 4,345,556 | 8/1982 | Crouillone | 123/339 |
| 4,359,983 | 11/1982 | Carlson et al. | 123/339 |
| 4,363,303 | 12/1982 | Takayama | 123/339 |

*Primary Examiner*—Raymond A. Nelli

*Attorney, Agent, or Firm*—Stevens, Davis, Miller & Mosher

[57] ABSTRACT

Disclosed is a carburetor containing an electromagnetic device for stopping a first lever, the first lever positions a throttle valve in one of two positions, each of which produces a small but different opening amount for the throttle valve. A common housing contains the electromagnetic device and an electronic control circuit operating it. A second lever operated by an accelerator pedal moves the first lever through a lost motion mechanism.

1 Claim, 7 Drawing Figures

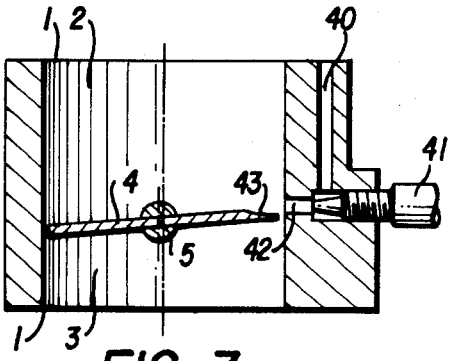
FIG. 3
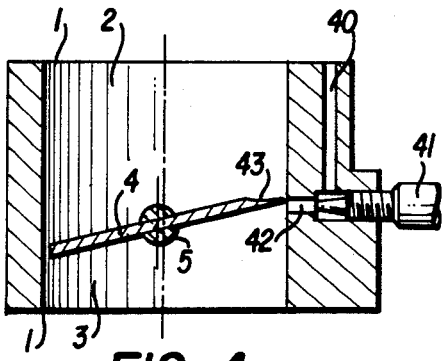
FIG. 4
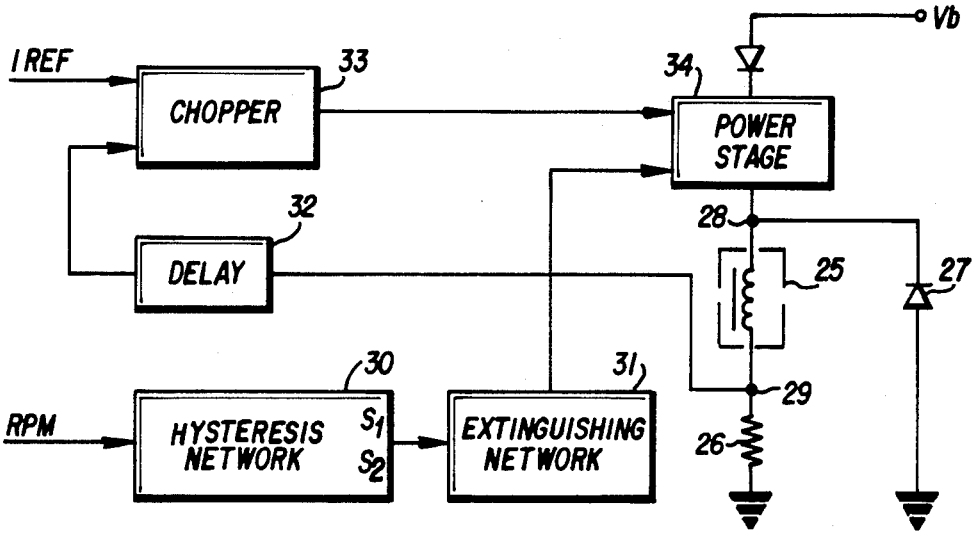
FIG. 5
FIG. 6a
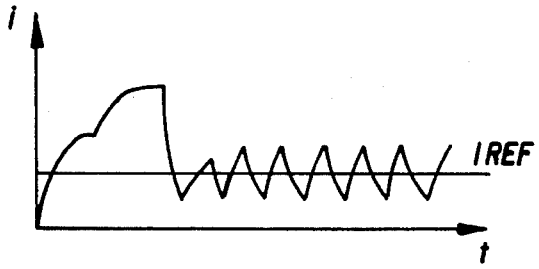
FIG. 6b
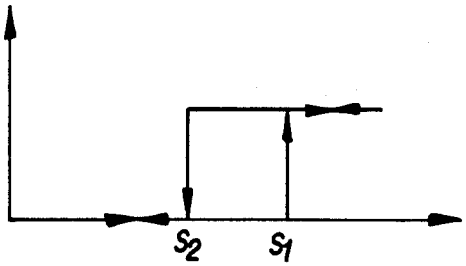

CARBURETOR FOR INTERNAL COMBUSTION ENGINES WITH ELECTROMAGNETIC CONTROLLED DEVICES FOR POSITIONING THE THROTTLE IN TWO POSITIONS WITH SMALL OPENINGS

The invention relates to carburetors for motor vehicle engines, comprising: a main barrel in which the air-fuel mixture sucked in by the engine is formed; a throttle situated in the main barrel to regulate the flow of the mixture; and an idle system to form the mixture during idle speed and low load phases of the engine, the circuit of which opens into the main barrel close to the throttle. It is a known fact that when the accelerator is released, the combustion heat of the mixture is not transformed into usable energy, so that fuel is wasted; it is therefore possible to reduce consumption by interrupting flow of the fuel during the phases of accelerator release; it has been proved that such an interruption also reduces the concentrations of pollutants emitted from the exhaust.

There are several known devices for interrupting the fuel flow; in particular, devices for positioning the throttle downstream of the idle speed mixture orifice; among these, the electromagnetic controlled devices are of interest; however, known devices of the above type have the disadvantage, among other things, of being very heavy, cumbersome and expensive, since their electrical parts must be big enough to develop magnetic forces capable of moving the main lever against the action of the particularly strong closing springs; moreover, they absorb current in a highly intense manner, which on one hand tends to discharge the battery and on the other heats the electrical the Joule effect; this being dangerous due to the presence of fuel near to the windings. Another disadvantage of known devices is the poor reliability for prolonged use in motor vehicles.

The invention, as characterised in the claims, mainly solves the following problem: it provides a carburetor whose throttle is situated downstream of the idle speed mixture by electromagnetic controlled devices of reduced overall dimensions and weight, which function by absorbing contained current intensities, which do not alter the correct development of carburation in the low load phases of the engine, which continue to be reliable during the life of the engine and which, finally, are economical.

The invention is described below in detail, referring to the drawings which represent one method of execution.

FIGS. 3 and 4 represent functional diagrams of the carburetor in question, in two distinct throttle positions corresponding respectively to the conditions shown in FIG. 1 and FIG. 2;

FIG. 5 shows a block diagram of the control gearbox;

FIGS. 6*a* and 6*b* represent particular excitation curves of the wiring diagram of FIG. 5.

Figure 1:
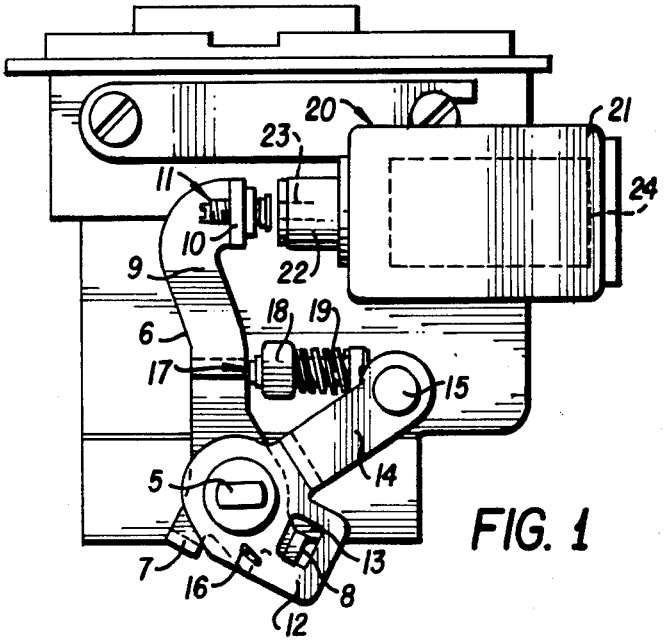
FIG. 1 shows a carburetor according to this invention in a first functional position.
Figure 2:
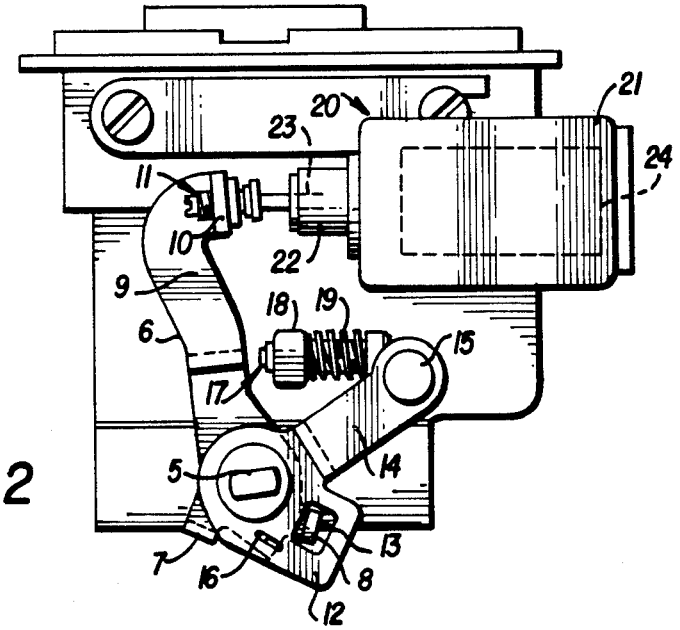
FIG. 2 shows the same carburetor in a second functional position.

FIGS. 1 to 4 represent a carburetor comprising a main barrel 1, subdivided by a throttle 4 into two parts, 2 and 3, which communicate respectively with the air filter and with the engine manifold; the throttle 4 turns integrally with a shaft 5.

The carburetor has an idle system 40 which opens into the barrel 1 by means of the mixture orifice 42 with variable bore by means of the taper-pointed idle mixture adjusting screw 41.

The throttle 4 has a milled part 43 on the edge nearest the orifice 42, which serves to position the latter so that it directly faces part 2 of the barrel 1, thus preventing the idle system 40 from being reached by a degree of vacuum, intended to draw out fuel when the throttle 4 is in the condition shown in FIG. 3.

The shaft 5 of the throttle 4 is integral with a lever 6 (FIGS. 1 and 2); an arm 7 of this is relatively short and terminates with a lug 8 turned upwards with respect to the drawing; attached to the arm 7 is a return spring 16, fixed to the carburetor body and which causes the clockwise rotation of the lever to close the throttle. A second arm 9, much longer than arm 7, is part of lever 6 and terminates with a second lug 10, also turned upwards with respect to the drawing and in which a cap screw 11 is inserted.

The carburetor body supports a bracket 18 in which a screw 19 is inserted, the point 17 of which is turned towards the arm 9 so as to define a first stopping position of the lever 6 as controlled by the spring 16. The same body supports a device 20, comprising a housing 21 which contains an electromagnet 22 and an electronic control circuit 24 for the electromagnet 22, the mobile keeper of which is integral with a push rod 23 for abutting against the screw 11 in order to define a second stopping position of lever 6 as controlled by the spring 16.

The electrical elements and the mechanical devices (springs not shown) connected to the electromagnet 22 move the push rod 23 to the left when the electromagnet 22 is energised and they pull it back to the right when the electromagnet 22 is de-energised.

A second lever 12 is slidably mounted on the shaft 5 and has a slot 13 and an arm 14; the slot 13 contains the lug 8 of the lever 6; the end of arm 14 supports a pin 15 to hook the accelerator pedal onto lever 12, which is equipped with its own elastic closing means, not shown. The slot 13 and the lug 8 have dimensions which allow reciprocal movements to obtain relative rotations of the two levers 12 and 6; this is particularly advantageous in the conditions of accelerator release, because it allows the push rod 23 to move the lever 12 from the position shown in FIG. 1 to that shown in FIG. 2, against the action of the spring 16 alone, operating the elastic forces of the accelerator pedal on lever 12 alone.

The electronic control circuit 24 is illustrated in FIG. 5; it comprises a speedometer hysteresis network 30 for defining two thresholds of operation $S_1$ and $S_2$ and for receiving RPM electrical impulses coming from the engine distributor, to send an outgoing signal to an extinguishing network 31, connected to a power stage 34, fed by the battery $V_b$. The stage 34 is connected to the solenoid 25 of the electromagnet 22 which is grounded by means of a feedback resistance 26; a diode 27 grounds the node 28 to close the mesh of the solenoid 25. A second node 29 is connected to power stage 34 through solenoid 25 and to a delaying network 32, the outgoing signal of which is sent to a chopper network 33, which contains a reference signal of current intensity $I_{ref}$ and whose outgoing signal is sent to the power stage 34.

The circuit 24 is formulated using already known "thick film" technology, which offers the advantages of being reliable because of its resistance both to vibrations caused by the engine and to thermal shocks, of being economical both intrinsically and because it needs a small number of electrical components, of having particularly contained overall dimensions and of being able to make use of miniaturised electrical components.

The functioning of the carburetor is now described. During the idle speed phases, the position of the throttle 4 is defined by the contact between the screw 11 and the push rod 23; the orifice 42 opens into part 3 of the barrel 1 and the throttle 4 assumes a small opening position which allows correct engine rate; in these conditions, the solenoid 25 of the electromagnet 22 is energized.

The speed of the engine is gradually increased, starting from idle speed, by depressing the accelerator pedal to cause the anti-clockwise rotation of the lever 12 connected to the accelerator by means of the pin 15; the left-hand edge of the slot 13 drags the lug 8 of the lever 6 into rotation to open the throttle 4 against the reaction of the spring 16.

When the rotation speed of the engine exceeds a certain value $S_1$, the speedometer hysteresis network 30 emits a signal to act on the power stage 34 to lock the energizing of the solenoid 25; this causes the push rod 23 to move back towards the right. If, starting from a speed exceeding $S_1$, the driver releases the accelerator to slow the vehicle down or to change gear, levers 12 and 6 are rotated clockwise by, respectively, the springs of the accelerator and the spring 16; the rotation of lever 6 terminates when the arm 9 abuts against the point 17 of the screw 19, thus determining the position of the throttle 4 shown in FIG. 3; the throttle 4 intercepts the primary mixture coming from the idle system 40, positioning the orifice 42 to face part 2 of the barrel 1, where there is no degree of vacuum.

In this phase, the engine is fed with air alone, thus saving fuel, reducing the pollutants emitted by the exhaust and increasing the braking effect of the engine. When the decreasing engine speed reaches a value of $S_2 < S_1$, the speedometer hysteresis network 30 sends and outgoing electric signal which enables the stage 34 to energize the solenoid 25 in order to position the push rod 23 as in FIG. 1. The value of the current which the solenoid receives from the stage 34 is influenced by the chopper network 32 and by the delaying network 33 and assumes the trend shown in FIG. 6*a*; immediately after the start of excitation, the current reaches relatively high values in order to guarantee a magnetic action which moves the push rod 23 to the left against the action of the spring 16, transmitted by the screw 11 which opposes it; subsequently, the action of networks 32 and 33 guarantees a current value notably less than the previous value, but sufficient to maintain the push rod 23 in the position shown in FIG. 1, balancing the action of the spring 16; in order to position and maintain the lever 6 as in FIG. 1, to which the position of the throttle 4 shown in FIG. 4 corresponds, the push rod 23 operates the lever with the arm 9 much longer the arm 7 of the spring 16, thereforce with a force inversely proportional to the ratio between the arms, thus being sufficiently contained as is the current which energizes the solenoid 25. The solenoid 25, however, remains energised for a period of time which is notably less than the time it remains deenergised thus avoiding the risk of overheating by Joule effect.

The hysteresis $S=(S_1-S_2)$ (FIG. 6*b*) between the intervention thresholds of the speedometer hysteresis network 30 serves to avoid the instability of the engine speed for useless interceptions when the engine is used at low speed.

We claim:

1. A carburetor for an internal combustion engine comprising:

a main barrel divided by a throttle valve into a first part which communicates with an air filter and a second part which communicates with an intake manifold;

an electromagnetic controlled device having a movable operating rod for positioning said throttle valve in two positions each of which maintains a respective small opening between said first and second parts of said main barrel;

a shaft for turning said throttle valve;

an idle system which opens into said barrel and including at least one mixture orifice which, when the throttle valve is in a first of said two positions, communicates with said first part and, when the throttle valve is in a second of said two positions, communicates with said second part;

first and second control levers for operating said throttle valve and on which, respectively, a return spring and an accelerator pedal act;

a first and second stopping members for defining, resspectively, said first and said second positions of the said throttle valve, said second stopping member being integral with the said operating rod, said stopping members and said return spring operating on said first lever which is fixedly connected on said shaft, said accelerator pedal operating on said second lever which is mounted to rotate on said shaft; said first and second levers being connected to each other by means of connecting members permitting a limited rotation of said first lever with respect to said second lever; one of said connecting members comprising a lug of said first lever which is inserted in a slot provided in said second lever; and, means for supporting a structure which contains said electro-magnetic device and an electrical control circuit responsive to engine RPM for operating said device.

* * * * *

UNITED STATES PATENT AND TRADEMARK OFFICE

CERTIFICATE OF CORRECTION

PATENT NO. : 4,502,436

DATED : March 5, 1985

INVENTOR(S) : BONFIGLIOLI et al.

It is certified that error appears in the above-identified patent and that said Letters Patent is hereby corrected as shown below:

Column 1, line 36, after "electrical" read --windings by--.

Column 3, line 43, for "and outgoing" read -- an outgoing--.

Column 4, line 3, for "longer the" read --longer than the --.

Column 4, line 4, for "thereforce" read --and therefore--.

Signed and Sealed this

*Thirtieth* Day of *July 1985*

[SEAL]

*Attest:*

DONALD J. QUIGG

*Attesting Officer*

*Acting Commissioner of Patents and Trademarks*